US009574561B2

(12) United States Patent
Kim et al.

(10) Patent No.: US 9,574,561 B2
(45) Date of Patent: Feb. 21, 2017

(54) SCROLL COMPRESSOR AND AIR CONDITIONER INCLUDING A SCROLL COMPRESSOR

(71) Applicant: LG ELECTRONICS INC., Seoul (KR)

(72) Inventors: Byeongsu Kim, Changwon-si (KR); Byoungjin Ryu, Changwon-si (KR); Beomchan Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 269 days.

(21) Appl. No.: 14/539,707

(22) Filed: Nov. 12, 2014

(65) Prior Publication Data

US 2015/0135764 A1 May 21, 2015

(30) Foreign Application Priority Data

Nov. 11, 2013 (KR) ..... 10-2013-0136498

(51) Int. Cl.

*F04C 18/02* (2006.01)
*F04C 29/00* (2006.01)
*F25B 31/02* (2006.01)

(52) U.S. Cl.

CPC ..... *F04C 18/0261* (2013.01); *F04C 18/0215* (2013.01); *F04C 18/0253* (2013.01); *F04C 29/0007* (2013.01); *F25B 31/026* (2013.01)

(58) Field of Classification Search

CPC ..... F25B 18/0261; F04C 29/0007; F04C 18/0253

See application file for complete search history.

(56) References Cited

U.S. PATENT DOCUMENTS 5,469,716 A * 11/1995 Bass ..... F04C 29/042 418/55.6
6,106,253 A * 8/2000 Sakai ..... F04C 29/0007 418/55.6
2007/0059193 A1* 3/2007 Maladkar ..... F04C 18/0215 418/55.5
2008/0236179 A1* 10/2008 Ignatiev ..... F25B 1/10 62/190

(Continued)

FOREIGN PATENT DOCUMENTS

EP 1 087 142 3/2001
JP 60-166778 8/1985
JP 63-147982 6/1988

OTHER PUBLICATIONS

European Search Report dated Jun. 5, 2015.

*Primary Examiner* — Emmanuel Duke
(74) *Attorney, Agent, or Firm* — Ked & Associates LLP

(57) ABSTRACT

A scroll compressor and an air conditioner including a scroll compressor are provided. The scroll compressor may include a casing, a fixed scroll, an orbiting scroll, and an injection passage. The fixed scroll may further include a first injection hole and a second injection hole formed on a spiral flow passage, and a third injection hole and a fourth injection hole formed on the spiral flow passage at a position inwardly rotated by about 360 degrees from the first injection hole and the second injection hole along the spiral flow passage. The first injection hole and the third injection hole may be formed on an outer lane of the spiral flow passage, and the second injection hole and the fourth injection hole may be formed on an inner lane of the spiral flow passage.

22 Claims, 9 Drawing Sheets

(56) References Cited

U.S. PATENT DOCUMENTS

| | | | | |
|---|---|---|---|---|
| 2009/0297379 | A1* | 12/2009 | Stover | F04C 18/0215<br>418/55.1 |
| 2010/0008807 | A1 | 1/2010 | Roof et al. | |
| 2010/0212352 | A1* | 8/2010 | Kim | F04C 18/0215<br>62/498 |
| 2010/0307173 | A1 | 12/2010 | Guo et al. | |
| 2012/0151948 | A1* | 6/2012 | Ogata | F04C 18/3564<br>62/157 |
| 2013/0081425 | A1* | 4/2013 | Jang | F04C 18/0292<br>62/498 |

* cited by examiner

SCROLL COMPRESSOR AND AIR CONDITIONER INCLUDING A SCROLL COMPRESSOR

CROSS-REFERENCE TO RELATED APPLICATION(S)

This application claims priority under 35 U.S.C. §119 to Korean Application No. 10-2013-0136498 filed in Korea on Nov. 11, 2013, whose entire disclosure is hereby incorporated by reference.

BACKGROUND

1. Field

A scroll compressor and an air conditioner including a scroll compressor are disclosed herein.

2. Background

An air conditioner is an electric home appliance that maintains indoor air in a state best fit to a use and purpose of the air. Such an air conditioner is an apparatus that cools or heats indoor air using a refrigerating cycle including a compressor, an outdoor heat-exchanger, an expansion valve, and an indoor heat-exchanger. That is, an air conditioner may include a cooler that cools the indoor air and a heater that heats the indoor air. An air conditioner may also be a two-way air conditioner that either heats or cools the indoor air. A compressor, which is a component of an air conditioner, is an apparatus that compresses refrigerant. There are piston-type compressors and scroll compressors.

The scroll compressor is a low-noise, high-efficiency compressor which is being widely used in the air conditioning equipment field. The scroll compressor uses a method in which a plurality of compression chambers are formed between two scrolls that rotate with respect to each other, the plurality of compression chambers continuously move toward a center decreasing their volume while refrigerant gas is continuously drawn in, compressed, and discharged.

To improve performance of a refrigerating cycle, a gas injection cycle may be used. A gas injection method injects into compression chambers gas-phase refrigerant that has a median pressure between a pressure of a refrigerant drawn into the scroll compressor and a pressure of a refrigerant discharged from the scroll compressor. There is also a method in which a plurality of injection passages are provided in a scroll compressor, and gas-phase refrigerant is supplied through each line into a plurality of compression chambers.

In a scroll compressor using a typical gas injection method, gas-phase refrigerant is injected into compression chambers using one injection hole. So a time during which the injection hole is open is short, and there is a limitation of reduction in injection efficiency due to a small amount of gas-phase refrigerant injected into the compression chambers.

BRIEF DESCRIPTION OF THE DRAWINGS

Embodiments will be described in detail with reference to the following drawings in which like reference numerals refer to like elements, and wherein.

DETAILED DESCRIPTION

Figure 1:
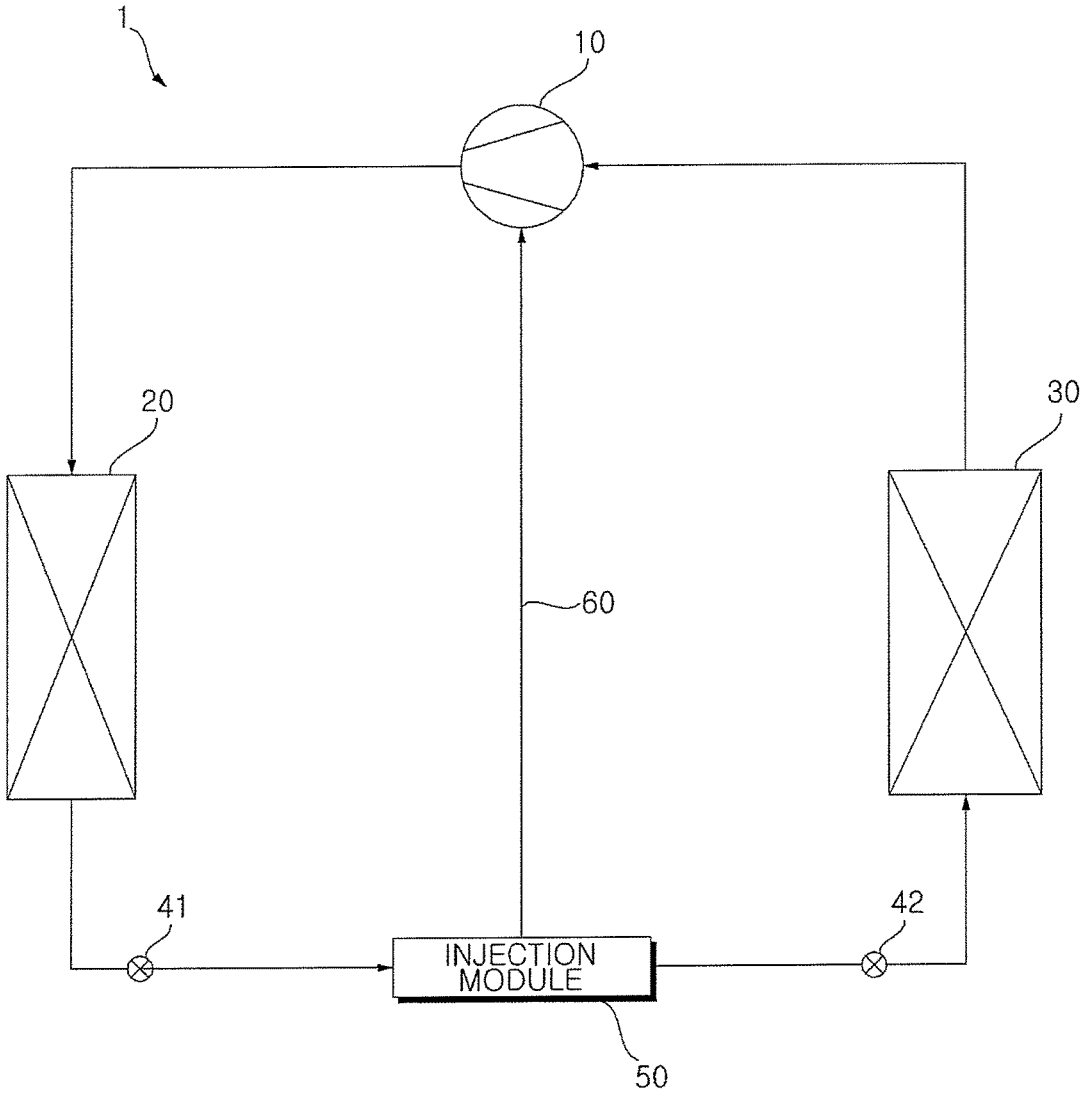
FIG. 1 is a schematic diagram of an air conditioner including a scroll compressor according to an embodiment.

The foregoing and other objects, features, aspects and advantages will become more apparent from the following detailed description when taken in conjunction with the accompanying drawings. Embodiments will now be described in detail with reference to the accompanying drawings. Embodiments may, however, be embodied in many different forms and should not be construed as being limited to the embodiments set forth herein. Rather, these embodiments are provided so that this disclosure will be thorough and complete, and will fully convey the scope to those skilled in the art. In the drawings, the shapes and dimensions may be exaggerated for clarity, and the same reference numerals will be used throughout to designate the same or like components.

Hereinafter, embodiments will be described in detail with reference to the accompanying drawings.

Figure 2:
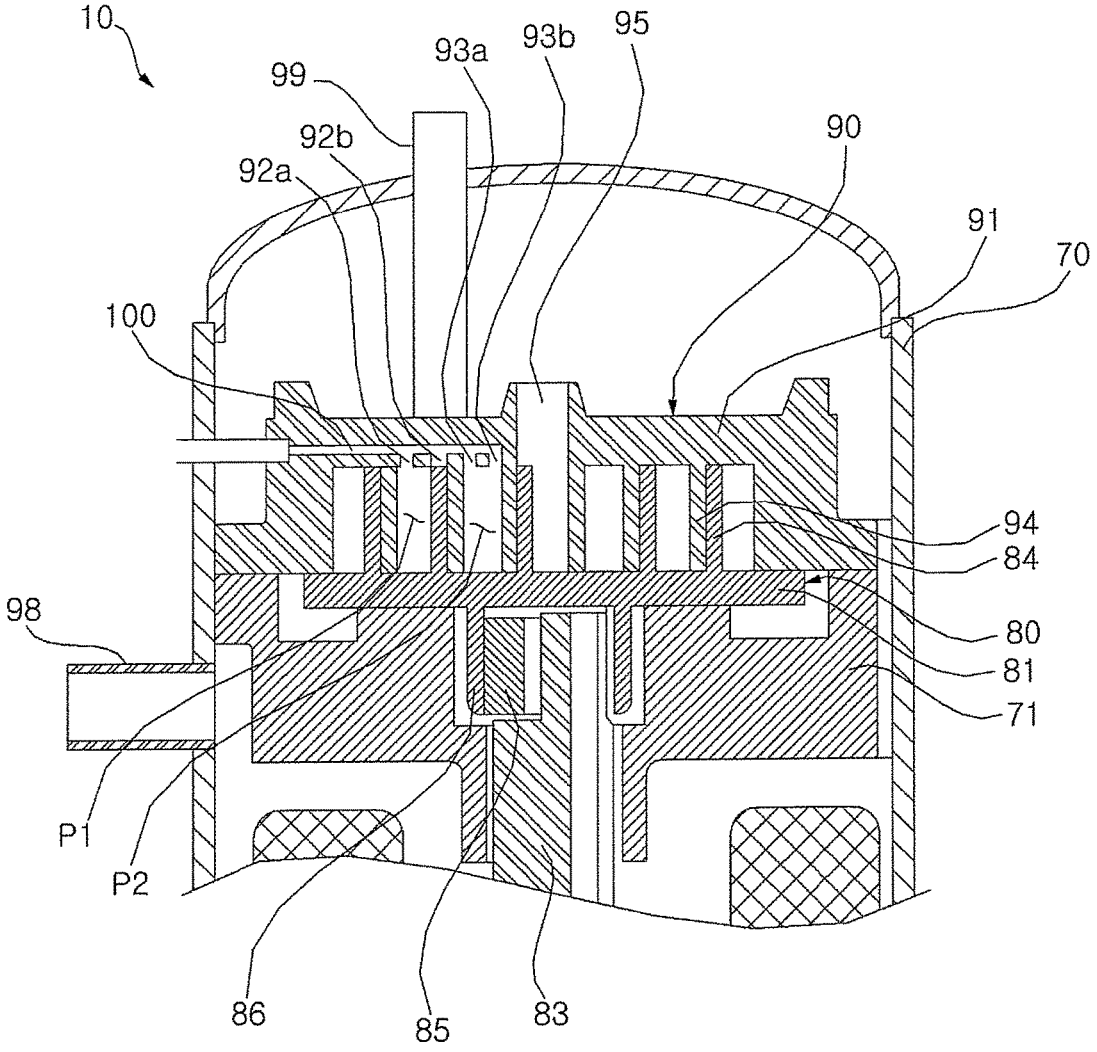
FIG. 2 is a cross-sectional view of a scroll compressor according to an embodiment.
Figure 3:
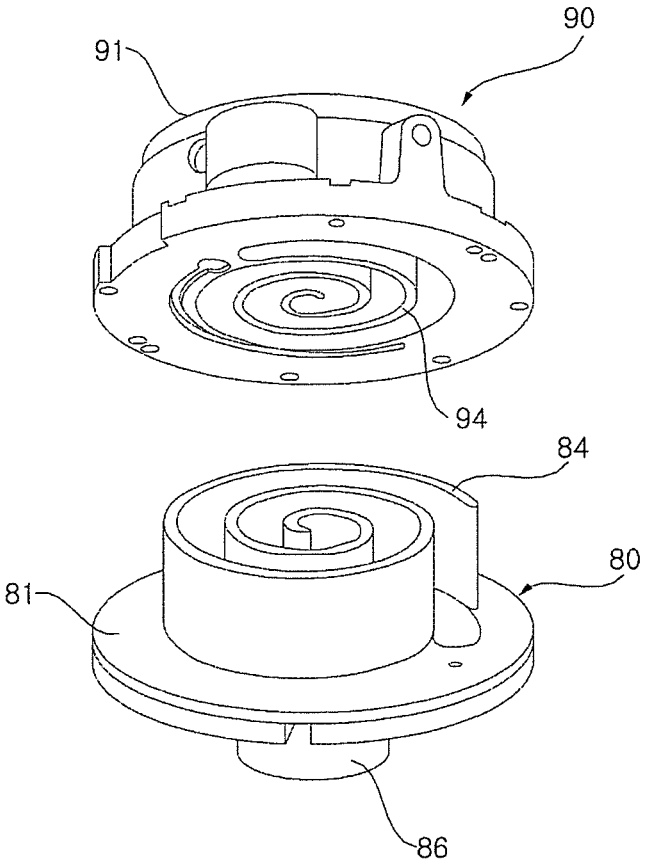
FIG. 3 is an exploded perspective view of the scroll compressor of FIG. 2.
Figure 4:
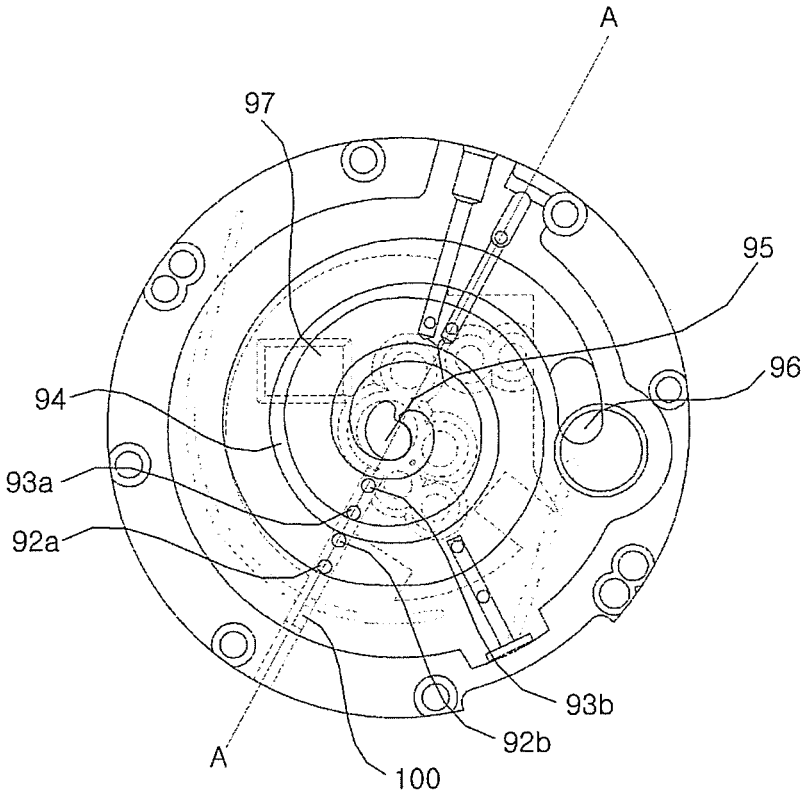
FIG. 4 is a view illustrating a bottom surface of a fixed scroll according to an embodiment.
Figure 5:
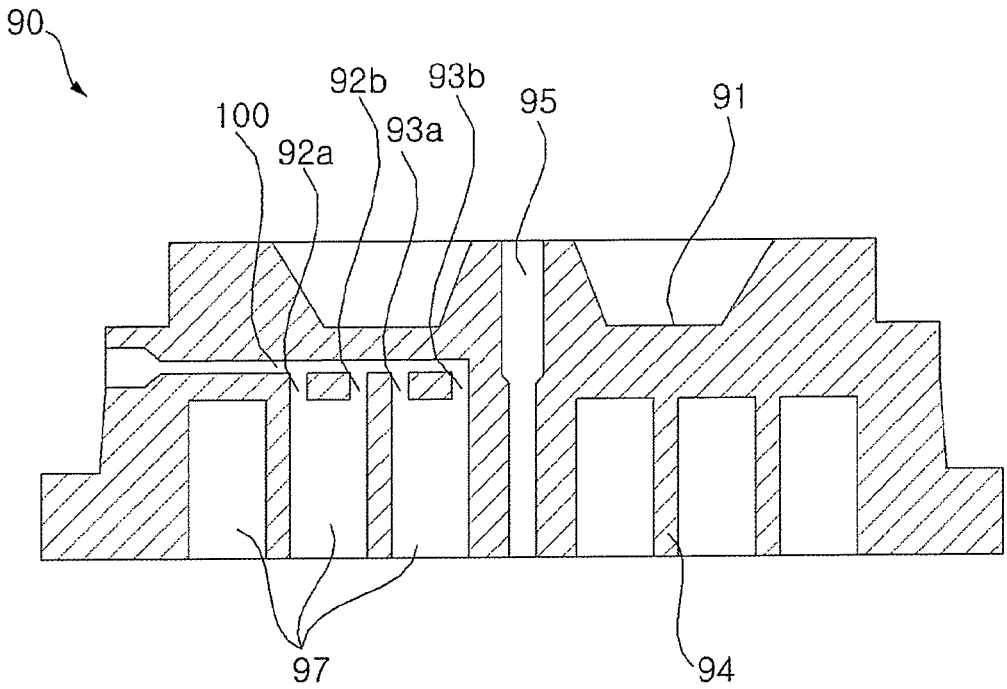
FIG. 5 is a cross-sectional view, taken along line V-V of FIG. 4.
Figure 6:
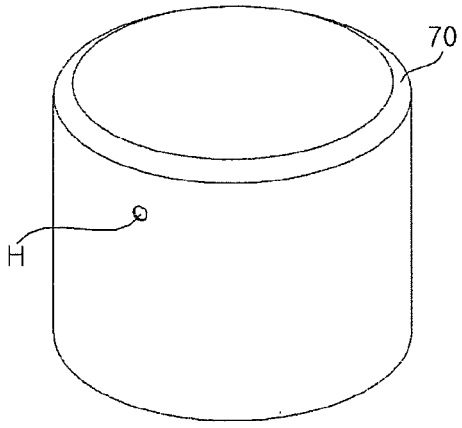
FIG. 6 is a perspective view illustrating a casing according to an embodiment.
Figure 7:
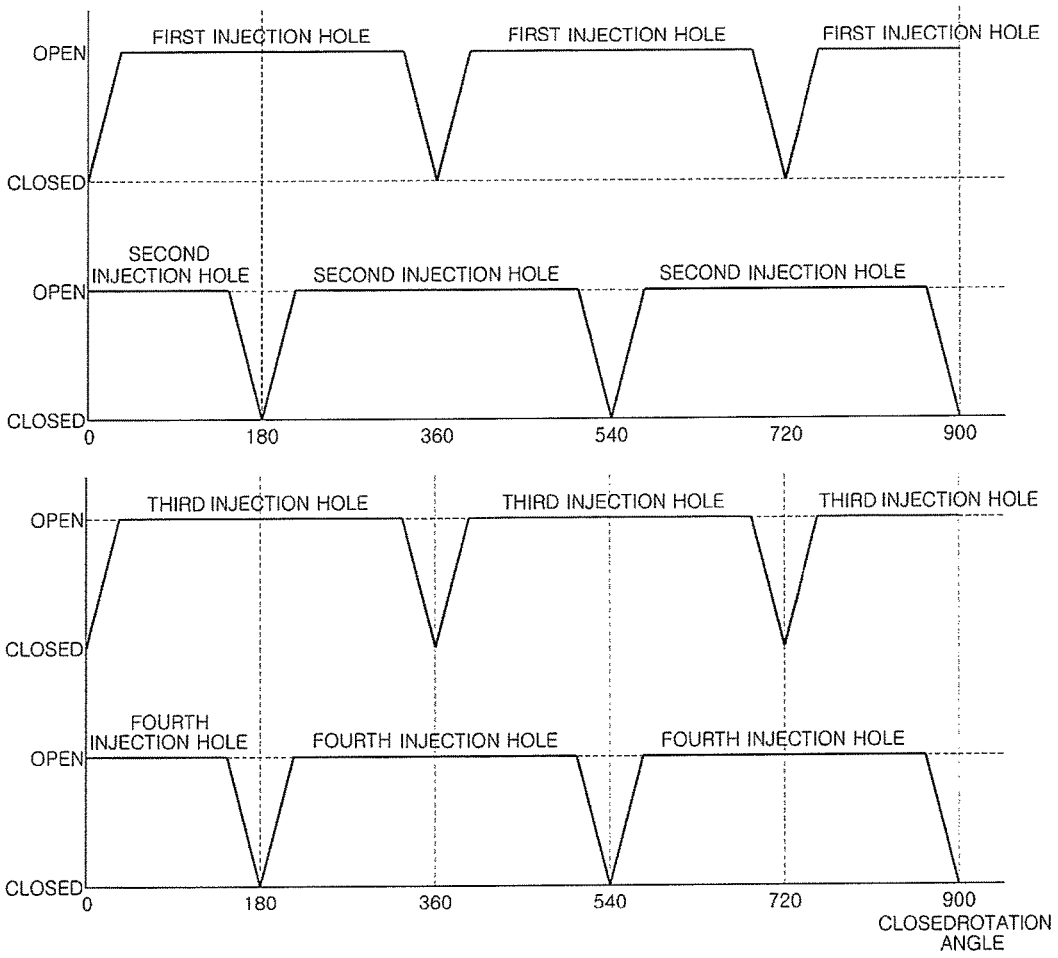
FIG. 7 is a graph illustrating an opening/closing process of a first injection hole, a second injection hole, a third injection hole, and a fourth injection hole according to an embodiment.

FIG. 1 is a schematic diagram of an air conditioner having a scroll compressor according to an embodiment. FIG. 2 is a cross-sectional view of a scroll compressor according to an embodiment. FIG. 3 is an exploded perspective view of the scroll compressor of FIG. 2. FIG. 4 is a view illustrating a bottom surface of a fixed scroll according to an embodiment. FIG. 5 is a cross-sectional view, taken along line V-V of FIG. 4. FIG. 6 is a perspective view illustrating a casing according to an embodiment. FIG. 7 is a graph illustrating an opening/closing process of a first injection hole, a second injection hole, a third injection hole, and a fourth injection hole according to an embodiment.

Referring to FIGS. 1 to 7, an air conditioner 1 according to an embodiment may be converted between a cooling operation cycle and a heating operating cycle by a converting valve (not shown). The air conditioner 1 may include a scroll compressor 10 that compresses refrigerant, the converting valve (not shown) that converts or changes a direction of refrigerant flow, a condenser 20 that condense refrigerant compressed through heat-exchange, an expansion valve 41 or 42 that expands the refrigerant, an evaporator 30 that evaporates the expanded refrigerant through heat-exchange, and an injection module 50 that injects a portion of refrigerant flowing between the condenser 20 and the evaporator 30 into the scroll compressor 10. The expansion valve 41 or 42 may include a first expansion valve 41, and a second expansion valve 42, and the injection module 50 may be disposed between the first expansion valve 41 and the second expansion valve 42. According to one embodiment, however, an accumulator (not shown) may be disposed between the evaporator 30 and the condenser 20 to separate gas-phase refrigerant and liquid-phase refrigerant.

The scroll compressor 10 is an apparatus that may be applied in the air conditioner 1 and that compresses refrigerant. The scroll compressor 10 may include a casing 70 that forms an enclosed space; a fixed scroll 90 including a fixed wrap 94 that forms a spiral flow passage 97; an orbiting scroll 80 rotatably disposed in the casing 70 and including an orbiting wrap 84 mutually engaged with the fixed wrap 94 to form a plurality of compression chambers P1 and P2; and an injection passage 100 provided on or at one side of the fixed scroll 90 to inject refrigerant into the plurality of compression chambers P1 and P2. The fixed scroll 90 may have a first injection hole 92*a* and a second injection hole 92*b* formed along the spiral flow passage 97, and a third injection hole 93*a* and a fourth injection hole 93*b* formed along the spiral flow passage 97. The first injection hole 92*a* and the third injection hole 93*a* may be formed on or at an outer side of the spiral flow passage 97, and the second injection hole 92B and the fourth injection hole 93B may be formed on or at an inner side of the spiral flow passage 97.

Hereinafter, considering the two compression chambers P1 and P2 of the plurality of the compression chambers, the compression chamber P2 formed closer to a center of the fixed scroll 90 may be referred to as a "high pressure compression chamber" because refrigerant in the chamber P2 is more compressed than the refrigerant in the other compression chamber P1, and the other compression chamber P1 may be referred to as a "low pressure compression chamber", because the refrigerant in the compression chamber P1 is less compressed than the refrigerant in the high pressure compression chamber P2.

The scroll compressor 10 may be connected to the evaporator 30, the condenser 20, and the injection module 50. The scroll compressor may be connected to the injection module 50 through a by-pass pipe 60. Refrigerant injected into the compression chambers P1 and P2 may have a median pressure between a suction pressure and a discharge pressure of the scroll compressor 10.

The casing 70 may have the enclosed space formed inside, and the fixed scroll 90, the orbiting scroll 80, and a frame 71 maybe disposed inside of the casing 70. The casing 70 may have a pipe hole H formed on a circumferential surface, through which the injection passage 100 may penetrate. The pipe hole H may be disposed along a same line with the first injection hole 92*a*, the second injection hole 92*b*, the third injection hole 93*a*, and the fourth injection hole 93*b*.

The frame 71 may be fixedly coupled inside the casing 70. The frame 71 may be coupled to the casing 70 by, for example, a bolt, or welded to a circumference of a bottom surface of a fixed plate 91, which is described hereinbelow. The orbiting scroll 80 may be disposed between the fixed scroll 90 and the frame 71.

The fixed scroll 90 may include the fixed plate 91, which may be formed in a disc shape, and the fixed wrap 94, which may be disposed on the fixed plate 91 in a spiral shape. The fixed wrap 94 according to this embodiment may be formed in a spiral shape that spirals by about 900 degrees around a center of the fixed plate 91. Accordingly, the fixed wrap 94 may form the spiral flow passage 97, which may spiral about 900 degrees around the center of the fixed plate 91. The fixed wrap 94 may form the plurality of compression chambers P1 and P2 by being mutually engaged with the orbiting wrap 84 of the orbiting scroll 80.

The spiral fixed wrap 94 may have an outer end connected to an inlet 96, which is described hereinbelow, and an inner end connected to a discharge hole 95. Thus, the spiral flow passage 97 may have its outer end connected to the inlet 96 and its inner end connected to the discharge hole 95. As refrigerant in the spiral flow passage 97 is more compressed while moving from the outer end to the inner end, the refrigerant may increase in pressure toward the inner end.

The fixed plate 91 may be fixed to the frame 71 by, for example, a bolt, or by welding. The fixed plate 91 may have the inlet 96 formed on a side thereof to suck in refrigerant evaporated at the evaporator 30. The inlet 96 may directly communicate with a suction pipe 98, which may be connected to the evaporator 30. The inlet 96 may introduce refrigerant into the plurality of compression chambers P1 and P2. The fixed plate 91 may have the discharge hole 95 formed in a center thereof to discharge the compressed refrigerant. The discharge hole 95 may communicate with a discharge pipe 99, such that compressed refrigerant may be discharged to the converting valve (not shown).

The fixed plate 91 may have an injection channel formed on one side to receive the injection passage 100. The injection channel may be formed to extend from an outer side to an inner side of the fixed hard plate 91.

The fixed plate 91 may have the first injection hole 92*a* and the second injection hole 92*b* formed on the spiral flow passage 97. The first injection hole 92*a* and the second injection hole 92*b* may be formed at a position less than about 360 degrees inwardly rotated from the outer end of the spiral flow passage 97. The first injection hole 92*a* may be formed on or at an outer lane of the spiral flow passage 97. The second injection hole 92*b* may be formed on or at an inner lane of the spiral flow passage 97. That is, spiral flow passage 97 may be divided into two lanes by a center line of the spiral flow passage 97: the outer lane and the inner lane. The outer lane may be an outer orbital of the spiral flow passage 97, and the inner lane may be an inner orbital of the spiral flow passage 97. In a same widthwise direction of the spiral flow passage 97, the outer lane may be nearer to an outer circumference of the fixed scroll 90 and the inner lane may be nearer to a center of the fixed scroll 90.

The fixed plate 91 may have the third injection hole 93*a* and the fourth injection hole 93*b* formed along the spiral flow passage 97 at a position about 360 degrees inwardly rotated from the injection hole 92*a* and the second injection hole 92*b* along the spiral flow passage 97. The third injection hole 93*a* may be formed on or at the outer lane of the spiral flow passage 97. The fourth injection hole 93*b* may be formed on or at the inner lane of the spiral flow passage 97. The first injection hole 92*a*, the second injection hole 92*b*, the third injection hole 93*a*, and the fourth injection hole 93*b* may be formed close to the fixed wrap 94.

Accordingly, the first injection hole 92*a*, the second injection hole 92*b*, the third injection hole 93*a*, and the fourth injection hole 93*b* may be disposed along a same line that extends from a center of the fixed scroll 90. The first injection hole 92*a*, the second injection hole 92*b*, the third injection hole 93*a*, and the fourth injection hole 93*b* may be disposed on the same line from or as the discharge hole 95.

The inlet 96 may not be disposed on the same line as the first injection hole 92*a*, the second injection hole 92*b*, the third injection hole 93*a*, and the fourth injection hole 93*b*. This is to prevent the injection passage 100 connected to the first injection hole 92*a*, the second injection hole 92*b*, the third injection hole 93*a*, and the fourth injection hole 93*b* from interfering with the inlet 96.

The orbiting scroll 80 may orbit inside the casing 70. The orbiting scroll 80 may be disposed between the frame 71 and the fixed scroll 90. The orbiting scroll 80 may include an orbiting plate 81, which may have a disc shape, an orbiting wrap 84 disposed on the orbiting plate 81 and having a spiral shape on a top surface of the orbiting plate 81, and a boss 86 disposed at a center of a bottom surface of the orbiting plate 81.

A central axial line of the orbiting scroll 80 may be a predetermined distance eccentric from a central axial line of the fixed scroll 90. The orbiting wrap 84 may be formed to overlap and move at a certain angle in a circumferential direction with respect to the fixed wrap 94. When the orbiting scroll 80 is allowed to orbit while the orbiting wrap 84 and the fixed wrap 94 are coupled, the plurality of compression chambers P1 and P2 may be formed. That is, the fixed scroll 90 and the orbiting scroll 80 may form the low pressure compression chamber P1 and the high pressure compression chamber P2. The high pressure compression chamber P2 may be positioned at a more inner position than the low pressure compression chamber P1. The plurality of compression chambers P1 and P2 may be shaped as crescent moons. As orbiting scroll 80 orbits, a space within the chambers P1 and P2 repeatedly expands and reduces, and refrigerant in the compression chambers P1 and P2 may be compressed accordingly.

The orbiting scroll 80 may have an oil supplying hole formed to introduce oil to a contact surface within the fixed scroll 90. An appropriate amount of oil needs to be supplied between the fixed scroll 90 and the orbiting scroll 80 in order for the orbiting scroll 80 to perform orbiting while being mutually engaged with the fixed scroll 90. The appropriate amount of oil needs to be steadily supplied into the compression chambers P1 and P2 to stop refrigerant from leaking from the compression chambers P1 and P2 formed by the mutually engaged fixed wrap 94 and orbiting wrap 84.

While orbiting, the orbiting scroll 80 may selectively open and close the first injection hole 92*a*, the second injection hole 92*b*, the third injection hole 93*a*, and the fourth injection hole 93*b*. Refrigerant may be injected into the compression chambers P1 and P2 through the opened injection holes (92*a*, 92*b*, 93*a*, or 93*b*) among the first injection hole 92*a*, the second injection hole 92*b*, the third injection hole 93*a*, and the fourth injection hole 93*b*. Refrigerant may not be injected into the compression chambers P1 and P2 through closed injection holes (92*a*, 92*b*, 93*a*, or 93*b*) among the first injection hole 92*a*, the second injection hole 92*b*, the third injection hole 93*a*, and the fourth injection hole 93*b*.

The first injection hole 92*a* may be closed when the orbiting scroll 80 further rotates by about 360 degrees after the first injection hole 92*a* starts to open. The second injection hole 92*b* may be start to open when the orbiting scroll 80 further rotates by about 180 degrees after the first injection hole 92*a* starts to open. Also, the second injection hole 92*b* may be closed when the orbiting scroll 80 further rotates by about 360 degrees after the second injection hole 92*b* starts to open.

The third injection hole 93*a* may start to open when the first injection hole 92*a* starts to open. The fourth injection hole 93*b* may start to open when the second injection hole 92*b* starts to open.

That is, when the first injection hole 92*a* and third injection hole 93*a* start to open together and the orbiting scroll 80 rotates by about 180 degrees, then the second injection hole 92*b* and the fourth injection hole 93*b* start to open together. When the second injection hole 92*b* and the fourth injection hole 93*b* start to open together and the orbiting scroll 80 rotates by about 180 degrees, the first injection hole 92*a* and third injection hole 93*a* may be closed together.

If described on the basis of a point in time of orbiting of the orbiting scroll 80, when the first injection hole 92*a* and the third injection hole 93*a* are closed, the second injection hole 92*b* and the fourth injection hole 93*b* may be open. Accordingly, refrigerant may be injected into the low pressure compression chamber P1 through the second injection hole 92*b* even though the first injection hole 92*a* is closed, and refrigerant may be injected into the high pressure compression chamber P2 through the fourth injection hole 93*b* even though the third injection hole 93*a* is closed.

When the second injection hole 92*b* and the fourth injection hole 93*b* are closed, the first injection hole 92*a* and the third injection hole 93*a* may be open. Accordingly, refrigerant may be injected into the low pressure compression chamber P1 through the first injection hole 92*a* even though the second injection hole 92*b* is closed, and refrigerant may be injected into the high pressure compression chamber P2 through the third injection hole 93*a* even though the fourth injection hole 93*b* is closed. Therefore, refrigerant may continuously be injected into the low pressure compression chamber P1 and the high pressure compression chamber P2 regardless of the orbiting of the orbiting scroll 80.

The injection passage 100 may be provided on or at the one side of the fixed scroll 90. The injection passage 100 may be connected to the first injection hole 92*a*, the second injection hole 92*b*, the third injection hole 93*a*, and the fourth injection hole 93*b* to inject refrigerant into the compression chambers P1 and P2. The injection passage 100 may inject refrigerant into the low pressure compression chamber P1 through the first injection hole 92*a* and/or the second injection hole 92*b*. The injection passage 100 may inject refrigerant into the high pressure compression chamber P2 through the third injection hole 93*a* and/or the fourth injection hole 93*b*.

The injection passage 100 may be inserted on or at the one side of the fixed scroll 90 through the injection channel formed in the fixed plate 91. The injection passage 100 may be connected to the by-pass pipe 60 through the pipe hole H of the casing 70. That is, the injection passage 100 may connect the by-pass pipe 60 and the compression chambers P1 and P2.

The injection passage 100 may be a flexible pipe. That is, the injection passage 100 may be formed of a substance with high ductility and heat and pressure resistance. For example, the injection passage 100 may be formed of copper.

The boss 86 may be coupled to a shaft 83 rotated by a drive motor (not shown). Accordingly, the boss 86 may orbit the orbiting scroll 80 due to a drive force transmitted from the drive motor (not shown).

Operations of a scroll compressor and an air conditioner including a scroll compressor configured as described above according to embodiments will be described hereinbelow.

When electric power is applied to a drive motor, the drive motor may rotate shaft 83. Accordingly, through an orbiting bearing (not shown) contained and supported by a crank 85 of the shaft 83, the orbiting scroll 80 may be rotated. By this performance, the orbiting scroll 80 orbits with a certain orbiting radius on the central axial line of the fixed scroll 90, and then the compressor 10 may start to operate.

When the compressor 10 compresses refrigerant, the compressed refrigerant may be condensed by the condenser 20. The condensed refrigerant may flow to the expansion valve 41 or 42 through the injection module 50. The expansion valve 41 or 42 may expand refrigerant, and the expanded refrigerant may be vaporized by the evaporator 30.

The injection module 50 may introduce a portion of refrigerant flowing between the condenser 20 and the evaporator 30 into the by-pass pipe 60.

The refrigerant vaporized in the evaporator 30 may be introduced into the scroll compressor 10 through the inlet 96 via suction pipe 98. Median pressure refrigerant from the injection module 50 may be passed though the by-pass pipe 60, and then, may be injected into the scroll compressor 10 through the injection passage 100.

When a rotational angle of the shaft 83 is a predetermined degree, intake of refrigerant through the inlet 96 may be completed. As the rotational angle increases, the first injection hole 92*a* and the third injection hole 93*a* may start to open together. When the first injection hole 92*a* and the third injection hole 93*a* are open, refrigerant from the injection module 50 may be injected into the low pressure compression chamber P1 and the high pressure compression chamber P2 separately.

When the orbiting scroll 80 rotates by about 180 degrees after the first injection hole 92*a* and the third injection hole 93*a* start to open, the second injection hole 92*b* and the fourth injection hole 93*b* may both be completely closed, and then may start to open together. When the second injection hole 92*b* and the fourth injection hole 93*b* are open, refrigerant from the injection module 50 may be injected into the low pressure compression chamber P1 and the high pressure compression chamber P2 separately.

When the orbiting scroll 80 rotates by about 180 degrees after the second injection hole 92*b* and the fourth injection hole 93*b* start to open, the first injection hole 92*a* and the third injection hole 93*a* may both be completely closed, and then, may start to open together. Similarly, when the orbiting scroll 80 continues to orbit, the compression chambers P1 and P2 may continue to move while orbiting. Also, as space within the chambers repeatedly expand and reduce, refrigerant in the compression chambers P1 and P2 may be compressed.

When refrigerant compressed from the compression chambers P1 and P2 reach the discharge hole 95 formed at the center of the fixed scroll 90, compressed refrigerant may be discharged to outside through the discharge hole 95 (via discharge pipe 99).

Figure 8:
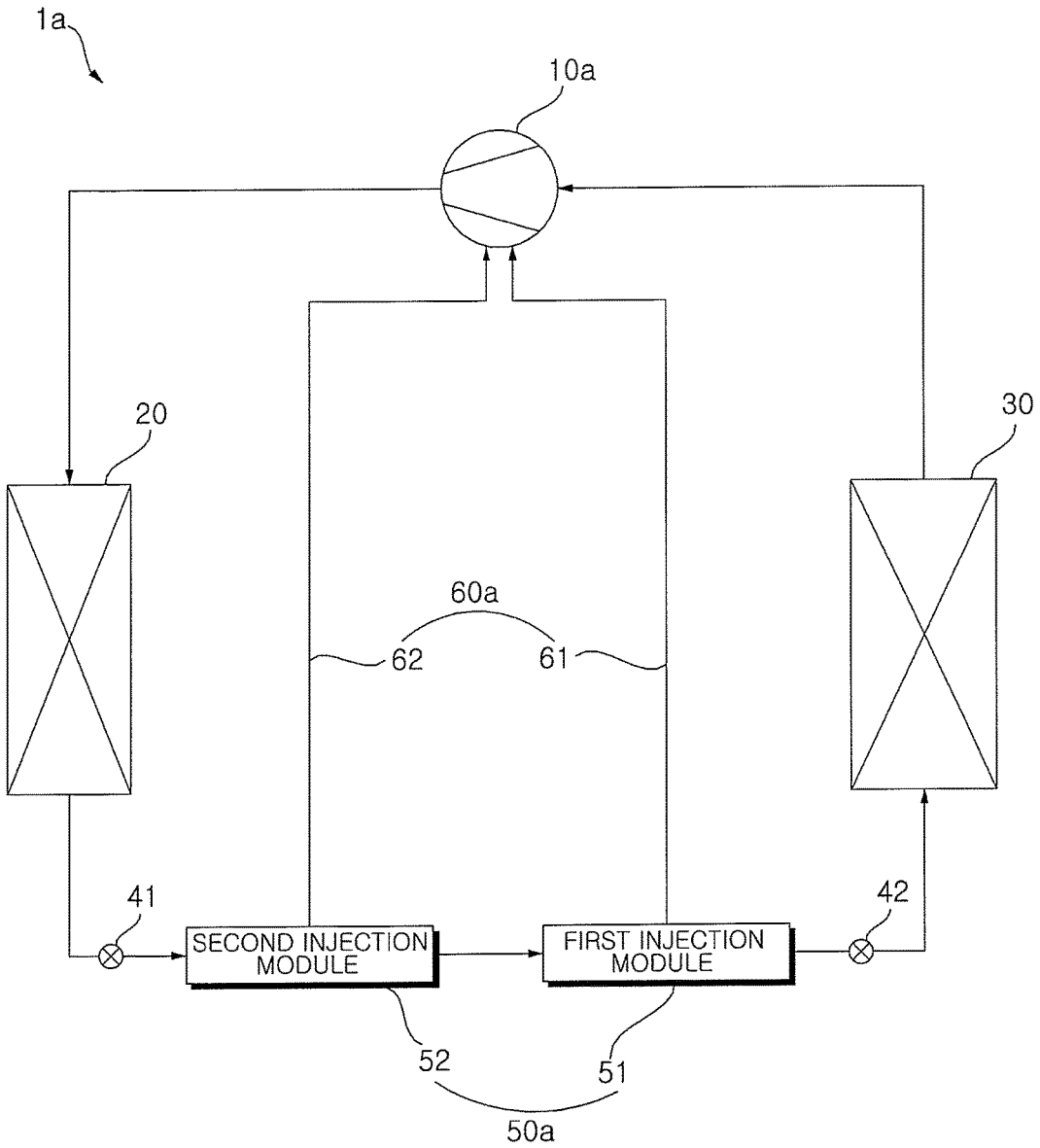
FIG. 8 is a schematic diagram of an air conditioner including a scroll compressor according to another embodiment.
Figure 9:
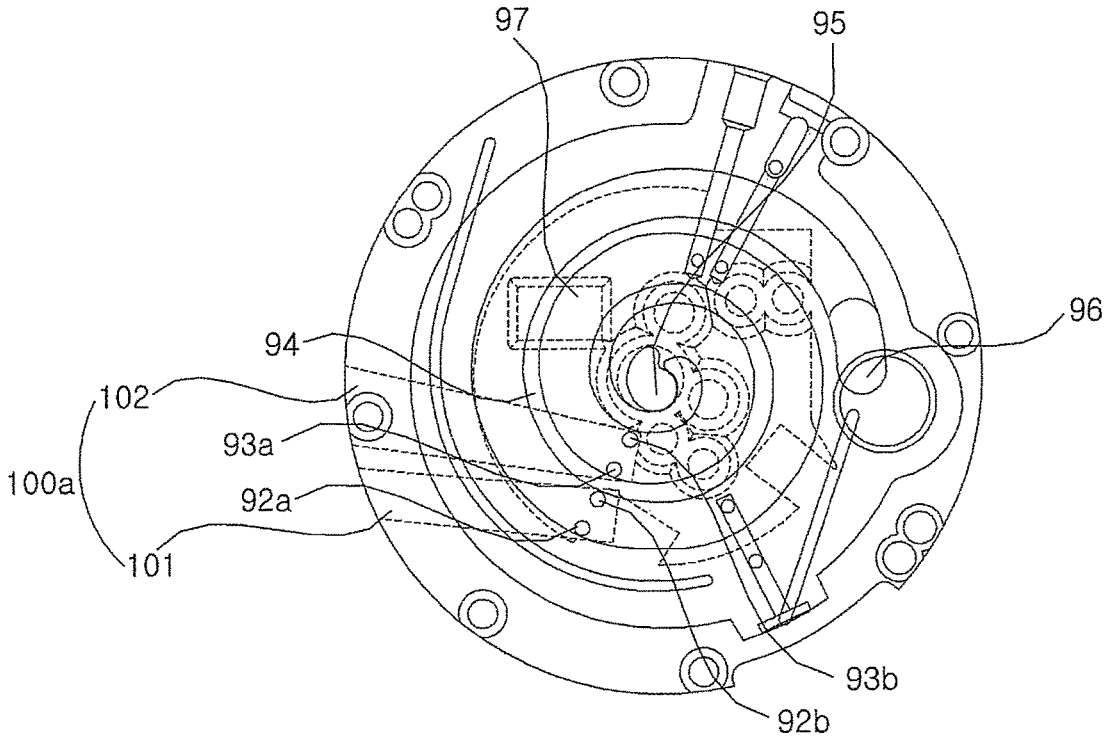
FIG. 9 is a view illustrating a bottom surface of a fixed scroll according to another embodiment.
Figure 10:
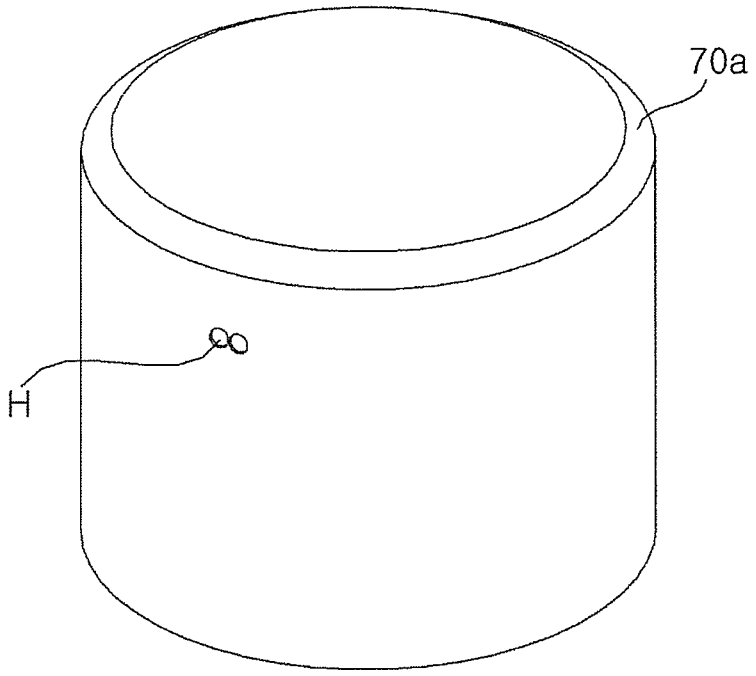
FIG. 10 is a perspective view illustrating a casing according to another embodiment.

FIG. 8 is a schematic diagram of an air conditioner including a scroll compressor according to another embodiment. FIG. 9 illustrates a bottom surface of a fixed scroll according to another embodiment. FIG. 10 is a perspective view illustrating a casing according to another embodiment.

In this embodiment of a scroll compressor and an air conditioner including a scroll compressor, the same terms as used in the previous embodiment described above will be used accordingly. Hereinafter, description will be focused on differences from that described with respect to the previous embodiments.

Referring to FIG. 8, an air conditioner la according to this embodiment may be converted between a cooling operation cycle to and a heating operation cycle by a converting valve (not shown). The air conditioner la may includes a scroll compressor 10*a* that compresses refrigerant, the converting valve (not shown) that converts a refrigerant flow direction, condenser 20 that condenses refrigerant compressed through heat-exchange, an expansion valve 41 or 42 that expands refrigerant, evaporator 30 that vaporizes expanded refrigerant through heat-exchange, a second injection module 52 that injects a portion of refrigerant that passed through the condenser 20 into the scroll compressor 10*a*, and a first injection module 51 that injects a portion of the refrigerant that passed through the second injection module 52 into the scroll compressor 10*a*.

The expansion valve 41 or 42 may include first expansion valve 41 and second expansion valve 42. The first injection module 51 and the second injection module 52 (collectively, injection module 50*a*) may be disposed between the first expansion valve 41 and the second expansion valve 42. In one embodiment, an accumulator (not shown) that separates gas-phase refrigerant and liquid-phase refrigerant may be disposed between the evaporator 30 and the scroll compressor 10*a*.

The first injection module 51 may be connected through a first by-pass pipe 61 to a first injection passage 101, which is described hereinbelow. The second injection module 52 may be connected through a second by-pass pipe 62 to a second injection passage 102, which is described hereinbelow. The first injection module 51 and the second injection module 52 may be collectively referred to as injection module 50*a*. The first by-pass pipe 61 and the second by-pass pipe 62 may be collectively referred to as by-pass pipe 60*a*. The first injection passage 101 and the second injection passage 102 may be collectively referred to as injection passage 100*a*.

The scroll compressor 10*a* may include a casing 70*a* that forms an enclosed space; fixed scroll 90 including fixed wrap 94 that forms spiral flow passages 97; orbiting scroll 80 rotatably disposed in the casing 70*a* and including orbiting wrap 84 mutually engaged with the fixed wrap 94 to form a plurality of compression chambers P1 and P2; and the first injection passage 101 and the second injection passage 102 disposed at one side of the fixed scroll 90 to inject refrigerant into the plurality of compression chambers P1 and P2. The fixed scroll 90 may have first injection hole 92*a* and second injection hole 92*b* formed on the spiral flow passage 97, and third injection hole 93*a* and fourth injection hole 93*b* formed on the spiral flow passage 97. The first injection hole 92*a* and the third injection hole 93*a* may be formed on an outer lane of the spiral flow passage 97, and the second injection hole 92*b* and the fourth injection hole 93*b* may be formed on an inner lane of the spiral flow passage 97.

The casing 70*a* may have a plurality of pipe holes H formed on a circumferential surface, through which the first injection passage 101 and the second injection passage 102 may penetrate. The plurality of pipe holes H may be disposed substantially parallel to each other.

The first injection passage 101 may be connected to the first injection hole 92*a*, the second injection hole 92*b*, and the first injection module 51. The second injection passage 102 may be connected to the third injection hole 93*b*, the fourth injection hole 93*b*, and the second injection module 52.

The first injection passage 101 may inject low pressure refrigerant into the low pressure compression chamber P1 through the first injection hole 92*a* and the second injection hole 92*b*. The second injection passage 102 may inject high pressure refrigerant into the high pressure compression chamber P2 through the third injection hole 93*a* and the fourth injection hole 93*b*. More specifically, the first injection passage 101 may be connected to the first injection module 51 through the first by-pass pipe 61, and the second injection passage 102 may be connected to the second injection module 52 through the second by-pass pipe 62.

Operations of a scroll compressor and an air conditioner including a scroll compressor configured as described above according to this embodiment will be described hereinbelow.

When electric power is applied to a drive motor, the drive motor may rotate shaft 83. Accordingly, through an orbiting bearing (not shown) contained and supported by crank 85 of the shaft 83, rotation may be transmitted to the orbiting scroll 80. By this performance, the orbiting scroll 80 may orbit with a predetermined orbiting radius on the central axial line of the fixed scroll 90, and then, the compressor 10 may start to operate.

When the compressor 10*a* compresses refrigerant, the compressed refrigerant may be condensed by the condenser 20. The condensed refrigerant may flow to the expansion valve 41 or 42 through the second injection module 52 and the first injection module 51. The expansion valve 41 or 42 may expand the refrigerant, and the expanded refrigerant may be vaporized by the evaporator 30.

The second injection module 52 may introduce a portion of the refrigerant flowing between the condenser 20 and the first injection module 51 into the second by-pass pipe 62. The first injection module 51 may introduce a portion of refrigerant flowing between the second injection module 52 and the evaporator 30 into the first by-pass pipe 61.

The refrigerant vaporized in the evaporator 30 may be introduced into the scroll compressor 10*a* through the inlet 96. High pressure refrigerant from the second injection module 52 may pass through the second by-pass pipe 62, and then, may be injected into the scroll compressor 10*a* through the second injection passage 102. Low pressure refrigerant from the first injection module 51 may pass through the first by-pass pipe 61, and then, may be injected into the scroll compressor 10*a* through the first injection passage 101.

When a rotational angle of the shaft 83 is a predetermined degree, intake of refrigerant through the inlet 96 may be completed. As the rotational angle increases, the first injection hole 92*a* and the third injection hole 93*a* may start to open together. When the first injection hole 92*a* and the third injection hole 93*a* are open, refrigerant from the first injection module 51 may be injected into the low pressure compression chamber P1 through the first injection hole 92*a*, and refrigerant from the second injection module 52 may be injected into the high pressure compression chamber P2 through the third injection hole 93*a*.

When the orbiting scroll 80 rotates by about 180 degrees after the first injection hole 92*a* and the third injection hole 93*a* start to open, the second injection hole 92*b* and the fourth injection hole 93*b* may both be completely closed, and then, start to be open together. When the second injection hole 92*b* and the fourth injection hole 93*b* are opened, refrigerant from the first injection module 51 may be injected into the low pressure compression chamber P1 through the second injection hole 92*b*, and refrigerant from the second injection module 52 may be injected into the high pressure compression chamber P2 through the fourth injection hole 93*b*.

When the orbiting scroll 80 rotates by about 180 degrees after the second injection hole 92*b* and the fourth injection hole 93*b* start to open, the first injection hole 92*a* and the third injection hole 93*a* may both be completely closed, and then, may start to open together. Similarly, when the orbiting scroll 80 continues to orbit, the compression chambers P1 and P2 may continue to move while orbiting. Also, as spaces within the chambers repeatedly expand and reduce, refrigerant in the compression chambers P1 and P2 may be compressed.

When refrigerant compressed in the plurality of compression chambers P1 and P2 reaches the discharge hole 95 formed at the center of the fixed scroll 90, compressed refrigerant may be discharged outside through the discharge hole 95.

A scroll compressor and an air conditioner including a scroll compressor according to embodiments disclosed herein have at least following advantages.

First, as a time for the injection hole to be open is increased, and thus, the time for refrigerant to be injected into the compressor is also increased, cooling and heating efficiency may be improved.

Second, as the injection holes are connected by a single injection passage, productivity may be improved, thereby reducing production costs.

Third, the air conditioner may improve its cooling and heating performance by allowing refrigerant to be injected into compression chambers at mutually different locations in the scroll compressor.

Advantages of embodiments are not limited to the above; other advantages that are not described herein will be clearly understood by the persons skilled in the art from the following claims.

Embodiments disclosed herein provide a scroll compressor that may increase an amount of refrigerant injected into the scroll compressor by increasing a time for an injection hole to be open and an air conditioner that includes a scroll compressor.

Embodiments disclosed herein provide a scroll compressor that may include a casing with a closed space; a fixed scroll including a fixed wrap defining a spiral flow passage; an orbiting scroll rotatably disposed in the casing and including an orbiting wrap adapted to mutually be engaged with the fixed wrap to form a plurality of compression chambers; and at least one injection passage provided at the fixed scroll to inject refrigerant into the plurality of compression chambers. The fixed scroll may include a plurality of injection holes in fluid communication with the spiral flow passage. The plurality of injection holes may include a first injection hole and a second injection hole, and a third injection hole and a fourth injection hole formed positioned approximately one spiral turn away from the first and the second injection hole along the spiral flow passage. The first injection hole and the third injection hole may be formed on an outer lane of the spiral flow passage, and the second injection hole and the fourth injection hole may be formed on an inner lane of the spiral flow passage.

The at least one injection passage may be in fluid communication with the first injection hole, the second injection hole, the third injection hole, and the fourth injection hole. The casing may have a pipe hole, through which the at least one injection passage may extend, and the pipe hole may be on a same line with the first injection hole, the second injection hole, the third injection hole, and the fourth injection hole.

The first injection hole may be positioned to be closed by the orbiting scroll after the orbiting scroll's 360 degree rotation from is positioned to start opening the first injection hole. The second injection hole may be positioned so as to start to open after the orbiting scroll's 180 degree rotation from its position to start to open the first injection hole, and then to be closed after the orbiting scroll's further rotation of about 360 degrees therefrom. The third injection hole may be positioned so as to start to open when the first injection hole starts to open based on the orbiting scroll's rotation, and to be closed when the first injection hole is closed. The fourth injection hole may be positioned so as to start to open when the second injection hole starts to open based on the orbiting scroll's rotation, and to be closed when the second injection hole is closed.

The injection holes may be positioned such that when the first injection hole and the third injection hole are closed by the orbiting scroll, the second injection hole and the fourth injection hole are open. The injection holes may be positioned such that when the second injection hole and the fourth injection hole are closed by the orbiting scroll, the first injection hole and the third injection hole are open.

The first injection hole and the second injection hole may be positioned within one spiral turn along the spiral flow passage from an outer end of the spiral flow passage. The outer end may be adapted to introduce refrigerant into the plurality of compression chambers.

The plurality of compression chambers may include a high pressure compression chamber, and a low pressure compression chamber. The injection passage may include a first injection passage connected to the first injection hole and the second injection hole to inject refrigerant into the low pressure compression chamber, and a second injection passage connected to the third injection hole and the fourth injection hole to inject refrigerant into the high pressure compression chamber.

The casing may have a plurality of pipe holes, through which the at least one injection passage may extend. The plurality of pipe holes may be substantially parallel to each other.

The first injection hole, the second injection hole, the third injection hole, and the fourth injection hole may be on a same line running through a center of the fixed scroll. An inlet to introduce refrigerant into the plurality of compression chambers, may not be on the same line as the first injection hole, the second injection hole, the third injection hole, and the fourth injection hole.

According to embodiments disclosed herein, there is provided an air conditioner that may include a scroll compressor; a condenser configured to condense refrigerant compressed by the scroll compressor; an expansion valve configured to expand the condensed refrigerant; an evaporator configured to vaporize the expanded refrigerant; and an injection module configured to inject a portion of refrigerant flowing between the condenser and the evaporator into the scroll compressor.

Although embodiments have been disclosed for illustrative purposes, those skilled in the art will appreciate that various modifications, additions and substitutions are possible, without departing from the scope of the invention as disclosed in the accompanying claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing forming an enclosed space;

a fixed scroll comprising a fixed wrap that defines a spiral flow passage;

an orbiting scroll rotatably disposed in the casing, and comprising an orbiting wrap adapted to mutually engage with the fixed wrap to form a plurality of compression chambers; and at least one injection passage provided in the fixed scroll to inject refrigerant into the plurality of compression chambers, wherein the fixed scroll comprises a plurality of injection holes in fluid communication with the spiral flow passage, wherein the plurality of injection holes includes a first injection hole and a second injection hole, and a third injection hole and a fourth injection hole positioned approximately one spiral turn away from the first and the second injection hole along the spiral flow passage, wherein the first injection hole and the third injection hole are formed on an outer lane of the spiral flow passage, and wherein the second injection hole and the fourth injection hole are formed on an inner lane of the spiral flow passage.

2. The scroll compressor of claim 1, wherein the at least one injection passage is in fluid communication with the first injection hole, the second injection hole, the third injection hole, and the fourth injection hole.

3. The scroll compressor of claim 1, wherein the casing comprises at least one pipe hole through which the at least one injection passage extends, and wherein the at least pipe hole is on a same line with the first injection hole, the second injection hole, the third injection hole, and the fourth injection hole.

4. The scroll compressor of claim 1, wherein the first injection hole is positioned so as to be closed by the orbiting scroll after the orbiting scroll has rotated about 360 degree from a position at which the first injection hole starts to open.

5. The scroll compressor of claim 1, wherein the second injection hole is positioned so as to start to open after the orbiting scroll has rotated about 80 degree from the position at which the first injection hole starts to open, and then, to be closed after the orbiting scroll further rotates about 360 degrees.

6. The scroll compressor of claim 1, wherein the third injection hole is positioned so as to start to open when the first injection hole starts to open based on rotation of the orbiting scroll and to be closed when the first injection hole is closed.

7. The scroll compressor of claim 1, wherein the fourth injection hole is positioned so as to start to open when the second injection hole starts to open based on rotation of the orbiting scroll and to be closed when the second injection hole is closed.

8. The scroll compressor of claim 1, wherein the plurality of injection holes is positioned such that when the first injection hole and the third injection hole are closed by the orbiting scroll, the second injection and the fourth injection hole are open.

9. The scroll compressor of claim 1, wherein the plurality of injection holes is positioned such that when the second injection hole and the fourth injection hole are closed by the orbiting scroll, the first injection hole and the third injection hole are open.

10. The scroll compressor of claim 1, wherein the first injection hole and the second injection hole are positioned within one spiral turn along the spiral flow passage from an outer end of the spiral flow passage, and wherein the outer end is adapted to introduce refrigerant into the plurality of compression chambers.

11. The scroll compressor of claim 1, wherein the plurality of compression chambers comprises a high pressure compression chamber and a low pressure compression chamber, and wherein the at least one injection passage comprises:

a first injection passage connected to the first injection hole and the second injection hole to inject refrigerant into the low pressure compression chamber; and a second injection passage connected to the third injection hole and the fourth injection hole to inject refrigerant into the high pressure compression chamber.

12. The scroll compressor of claim 11, wherein the casing comprises a plurality of pipe holes through which the first injection passage and the second injection passage, respectively, extend, and wherein the plurality of pipe holes is substantially parallel to each other.

13. The scroll compressor of claim 1, wherein the first injection hole, the second injection hole, the third injection hole, and the fourth injection hole are on a same line that extends through a center of the fixed scroll.

14. The scroll compressor of claim 13, wherein a discharge hole to discharge compressed fluid from the plurality of compression chambers is on the same line as the first injection hole, the second injection hole, the third injection hole, and the fourth injection hole.

15. The scroll compressor of claim 13, wherein an inlet to introduce refrigerant into the plurality of compression chambers is not on a same line as the first injection hole, the second injection hole, the third injection hole, and the fourth injection hole.

16. An air conditioner comprising the scroll compressor of claim 1.

17. An air conditioner, comprising the scroll compressor of claim 1, the air conditioner further comprising:

a condenser configured to condense refrigerant compressed by the scroll compressor;

at least one expansion valve configured to expand the condensed refrigerant;

an evaporator configured to vaporize the expanded refrigerant; and at least one injection module configured to inject a portion of refrigerant flowing between the condenser and the evaporator into the scroll compressor.

18. The air conditioner of claim 17, wherein the at least one injection module comprises a first injection module and a second injection module, wherein the first injection module injects a portion of the refrigerant flowing between the condenser and the evaporator to the first injection hole and the second injection hole, and wherein the second injection module injects a portion of the refrigerant flowing between the condenser and the evaporator to the third injection hole and the fourth injection hole.

19. A scroll compressor, comprising:

a casing forming an enclosed space;

a fixed scroll comprising a fixed wrap that defines a spiral flow passage;

an orbiting scroll rotatably disposed in the casing, and comprising an orbiting wrap coupled with the fixed wrap to form a plurality of compression chambers; and at least one injection passage provided in the fixed scroll to inject refrigerant into the plurality of compression chambers, wherein the fixed scroll comprises a plurality of injection holes in fluid communication with the spiral flow passage, wherein the plurality of injection holes includes a first injection hole and a second injection hole, and a third injection hole and a fourth injection hole positioned approximately one spiral turn away from the first and the second injection hole along the spiral flow passage, wherein the first injection hole, the second injection hole, the third injection hole, and the fourth injection hole are formed on a same line that extends through a center of the fixed scroll.

20. The scroll compressor of claim 19, wherein a discharge hole to discharge compressed fluid from the plurality of compression chambers is on the same line as the first injection hole, the second injection hole, the third injection hole, and the fourth injection hole.

21. The scroll compressor of claim 19, wherein an inlet to introduce refrigerant into the plurality of compression chambers is not on a same line as the first injection hole, the second injection hole, the third injection hole, and the fourth injection hole.

22. An air conditioner comprising the scroll compressor of claim 19.

* * * * *